United States Patent [19]

Yamazaki et al.

[11] Patent Number: 4,609,617

[45] Date of Patent: Sep. 2, 1986

[54] POLYESTER FILM SUPPORT HAVING EPOXY COPOLYMER COATING FOR PHOTOGRAPHIC USE

[75] Inventors: Toshiaki Yamazaki, Tachikawa; Takanori Nakadate, Hachioji; Kenichi Kitahara, Hino; Morio Kobayashi, Sagamihara; Noboru Fujimori, Hino; Ryuji Shimosaki, Tsukui, all of Japan

[73] Assignee: Konishiroku Photo Industry Co., Ltd., Japan

[21] Appl. No.: 544,992

[22] Filed: Oct. 24, 1983

[30] Foreign Application Priority Data

Oct. 25, 1982 [JP] Japan ..... 57-188013

[51] Int. Cl.[4] ..... G03C 1/76

[52] U.S. Cl. ..... 430/535; 428/413; 428/480; 430/533; 430/534

[58] Field of Search ..... 430/533, 534, 535; 428/413, 480

[56] References Cited

U.S. PATENT DOCUMENTS 4,116,696 9/1978 Tatsuta et al. ..... 430/533
4,124,395 11/1978 Ochiai et al. ..... 430/532
4,229,523 10/1980 Ohta et al. ..... 430/533
4,265,946 5/1981 Yabe et al. ..... 430/533
4,366,239 12/1982 Shinagawa et al. ..... 430/533

OTHER PUBLICATIONS

Grawe et al., Journal of Coating Technology, 50[645] 70–100, Oct. 1978.

*Primary Examiner*—Jack P. Brammer
*Attorney, Agent, or Firm*—Finnegan, Henderson, Farabow, Garrett & Dunner

[57] ABSTRACT

A support for photographic use comprising a polyester film with at least one surface having a layer provided by coating with an aqueous coating composition, the coating composition comprising a copolymer containing (a) from about 0.01% to about 70% by weight glycidyl acrylate or glycidyl methacrylate with an expoxy-ring-opening ratio of the glycidyl group to the whole amount of epoxy rings of from 5 to 35 mole %; and (b) a monomer polymerizable with the glycidyl group selected from the group consisting of alkylacrylic acid ester, an alkylmethacrylic acid ester, an acrylamide, an N-alkylacrylamide, vinyl chloride, vinylidene chloride, styrene, a styrene derivative, a vinyl ether, a vinyl ester, a diolefin or a combination thereof.

8 Claims, No Drawings

POLYESTER FILM SUPPORT HAVING EPOXY COPOLYMER COATING FOR PHOTOGRAPHIC USE

BACKGROUND OF THE INVENTION

1. Field of the Invention

This invention relates to a support for photographic use which has a subbing layer thereon, and more particularly to a polyester support for photographic use to which a subbing process is applied by coating thereon with a particular aqueous copolymer composition with the purpose of tightly adhering thereon such a hydrophilic colloidal layer as a light-sensitive emulsion layer, a backing layer or the like.

2. The State of the Prior Art

Polyester films are excellent in physical properties to serve as the supports of silver halide photographic light-sensitive materials and the like, and accordingly there is a great demand for this article and a wide use thereof in recent years. Such polyester films are sometimes attended with difficulties to adhere to a support like the above with a hydrophilic colloidal layer such as a photographic gelatin layer using a binder such as gelatin, because such polyester films are hydrophobic. Heretofore, there have been known many subbing processes in the photographic light-sensitive materials having used polyester films to make the support adhere to the hydrophilic colloidal layers. There have however been many instances, in any of the above subbing processes, where swelling agents or dissolving agents for polyester films should have been used to make tightly adhere such hydrophilic colloidal layers and inter alia photographic gelatin layer to the supports. In the case, however, that a subbing composition containing such a swelling agent or dissoloing agent should have been coated on a polyester film, there have been many defects such as an impediment of safety and hygiene in work operations and the like, because the flatness of the support has been worsened in the course of subbing treatment or most of the swelling agents or dissolving agents have used harmful organic solvents. Therefore, there have been proposed the subbing treatment without using any swelling agent or dissolving agent.

In one of the subbing techniques, there has proposed a polyester film whose surface is treated chemically or physically to serve as a support applied with such a surface activation treatment as a chemical treatment, a mechanical treatment, a corona discharge treatment, a flame treatment, an ultraviolet ray treatment, a high-frequency treatment, a glow discharge treatment, an active plasma treatment, a laser treatment, a mixed acid treatment, an ozone-oxidation treatment and the like. This technique has been proposed in U.S. Pat. Nos. 2,943,937, 3,475,193, 3,615,557, and 3,590,107; British Patent No. 1,215,234; and Japanese Patent Publication Open to Public Inspection (hereinafter called Japanese Patent O.P.I. Publication) Nos. 13672/1978 and 18469/1980, respectively. These surface-treated polyester films have been unsatisfactory in adhesion strength while the adhesion thereof to a hydrophilic protective colloidal layer for photographic use has increased.

In addition to the above, with the purpose of increasing the adhesion thereof to a hydrophilic colloidal layer for photographic use, there has proposed a polyester film to which an aqueous coating composition layer has been provided after a surface treatment was applied to the surface of the film. This type of aqueous coating composition layer, i.e., a subbing layer, is required to be satisfactorily adhesive to both of the polyester film and the hydrophilic colloidal layer for photographic use. In particular, with the purpose of making a subbing layer adhere satisfactorily to a hydrophilic colloidal layer, a hydrophilic group or a reactive group is popularly included in the components of resin (hereinafter called a subbing resin) in a subbing layer. As such hydrophilic groups or reactive groups as mentioned above, there may be given, for example, such an acid as acrylic acid, itaconic acid, a semialkyl ester of itaconic acid and the like; an N-alkanol group such as N-methylol acrylamide, hydroxymethylated N-(1,1-dimethyl-3-oxobutyl) acrylamide and the like; a hydroxyl group such as hydroxyethyl methacrylate, hydroxyethyl acrylate and the like; an epoxy group such as glycidyl acrylate, glycidyl methacrylate and the like; and the like.

Among the above described, the examples of such subbing layers containing subbing resins containing acid components have been disclosed in Japanese Patent Examined Publication No. 3564/1973; Japanese Patent O.P.I. Publication Nos. 1123/1971, 1718/1975, 61518/1979, and 39536/1975; European Patent Publication No. 1484; U.S. Pat. No. 3,545,972; and the like. However, in a polyester film bearing thereon a subbing layer containing an acid component within the subbing resins of the subbing layer, the adhesion strength of the hydrophilic protective colloidal layer has been unsatisfactory when developing.

The examples of subbing layers each containing subbing resins containing N-alkanol group components have been respectively disclosed in French Pat. No. 140,408, Japanese Patent O.P.I. Publication No. 131516/1976, British Pat. No. 1,178,591, Japanese Patent Examined Publication No. 3054/1982 and the like. These types of N-alkanol acrylamide disclosed in the above patents were serious in self-bridged bonding property to cause a bridged bond in the course of synthesizing subbing resins or during the preservation of a synthetic solution, so that the stability of such synthetic solutions and subbing solutions were not satisfactory.

The examples of subbing layers each containing subbing resins containing hydroxyl group components have been disclosed in Japanese Patent O.P.I. Publication Nos. 69138/1980, 19786/1977, 135526/1976, 123139/1976, 113868/1974 and the like.

In was however difficult to stably perform any subbing treatment with the subbing resins disclosed in the above-mentioned patents, because the synthetic solution of the subbing resins or the aqueous composition containing the subbing resins, each of which is a processed solution for subbing use (hereinafter called a "subbing solution"), is apt to be chemically degenerated or mechanically instable.

The examples of subbing layers each containing subbing resins containing epoxy group components have been disclosed in Japanese Patent O.P.I. Publication Nos. 9629/1959, 58469/1976, 104913/1977, 27918/1976, 19786/1977, 30121/1979, 121323/1976 and 69138/1980; and British Pat. No. 1,168,171; and the like.

It was however impossible to stably perform any constant subbing treatment, because the adhesion of the subbing solution containing the described subbing components was instable.

As mentioned above, with the polyester films for photographic use each having the subbing layer containing the subbing resins containing a hydrophilic group or a reactive group, the stability of the polyester films and the subbing capability thereof were not always satisfactory at the time of manufacture.

SUMMARY OF THE INVENTION

It is, accordingly, an object of the invention to provide a support for photographic use which can be stably manufactured without any deterioration in the subbing capability even if there should be some variation of coating and drying conditions in a subbing process.

Another object of the invention is to provide a support for photographic use having a strong adhesion strength of a polyester film to a hydrophilic colloidal layer for photographic use.

A further object of the invention is to provide a support for photographic use which does not necessitate to use any swilling agent or any dissolving agent for polyesters and, therefore, does not accompany any environmental pollution caused by harmful organic solvents.

An even further object of the invention is to provide a support for photographic use which is excellent in flatness.

A still further object of the invention is to provide a support for photographic use having thereon a subbing layer comprising resins for subbing use which are manufactured stably and readily.

It is, lastly, another object of the invention to provide a support for photographic use which does not affect various types of hydrophilic colloydal layers for photographic use and in particular photographic emulsion layers.

The inventors devoted themselves to study variously, and it was resultantly found that the described objects of the invention can be achieved by a polyester support for photographic use being provided on at least one surface thereof with a layer coated with an aqueous coating composition substantially comprising a copolymer containing glycidyl acrylate or glycidyl methacrylate to serve as a copolymer component and whose epoxy-ring-opening ratio of the glycidyl group to the whole amount of epoxy rings is from 5 to 35 mole %.

In the invention, the inventors paid attention to the use of resins for subbing use containing an expoxy-containing monomer to serve as a copolymer component, and thus found the fact that the stable subbing capability can be displayed without defect in the particular case of using resins for subbing use in which the rings of the described epoxy groups are opened in a specific ratio. This fact has not been expected at all from any of the conventional technologies.

DETAILED DESCRIPTION OF THE INVENTION

Referring further to the essential points of the invention in detail, a support for photographic use of the invention can be produced in the process that at least one surface of a polyester support is coated with an aqueous coating composition comprising a copolymer containing glycidyl acrylate or glycidyl methacrylate to serve as a copolymer component whose ring-opening ratio of the glycidyl group to the whole epoxy amount is from 5 to 35 mole %.

In a copolymer relating to the invention containing glycidyl acrylate or glycidyl methacrylate to serve as a copolymer component, as the monomers capable of copolymerizing with the described copolymer components, there are given, for example, an alkylacrylic acid ester, an alkylmethacrylic acid ester, an acrylamide, an N-alkylacrylamide, vinyl chloride, vinylidene chloride, styrene, a styrene derivative, a vinyl ether, a vinyl ester, a diolefin and the like; and they may be used independently or in combination.

The following are given as some typical examples of the combination of the monomers preferable to be used in the invention:

(1) Glycidyl methacrylate-ethyl acrylate,
(2) Glycidyl methacrylate-ethyl acrylate-styrene,
(3) Glycidyl methacrylate-propyl acrylate-styrene,
(4) Glycidyl methacrylate-butyl acrylate-styrene,
(5) Glycidyl acrylate-butyl acrylate-styrene,
(6) Glycidyl methacrylate-butadiene-styrene,
(7) Glycidyl acrylate-butadiene-styrene, and,
(8) Glycidyl methacrylate-isoprene-styrene.

In the invention, the monomers of the copolymers and the combination thereof shall not be limited to the above-mentioned examples.

In the case of a too small proportion of glycidyl acrylate or glycidyl methacrylate in a copolymer comprising such a monomer combination as described above according to the invention, the adhesion strength thereof is weakened in a developing process; while in the case of a too large proportion, the adhesion strength is weakened in a drying process after the development.

Accordingly, the preferable proportion of glycidyl acrylate or glycidyl methacrylate within a copolymer relating to the invention is 0.01 to 70% by weight to the copolymer, and particularly, 5 to 50% by weight.

In a glycidyl acrylate copolymer or a glycidyl methacrylate copolymer relating to the invention, if the ring-opening ratio of epoxy in a glycidyl group is too low, the adhesion strength is weakened in a development process, while if it is too high, the adhesion strength becomes weak when drying after the development was made; and besides, the mechanical stability of subbing solution is deteriorated.

Therefore, the described ring-opening ratio of epoxy in a glycidyl group is from 5 to 35 mole %, and preferably in particular, 10 to 25 mole %.

The ring-opening ratio of epoxy in a glycidyl group in the invention is a value measured in a hydrochloric acid-pyridine method, as described in, for example, "Papers of Macromolecules", Vol. 34, No. 8, pp. 571–576, August, 1977. The value can be obtained by the following formula:

$$\text{Epoxy-ring-opening ratio of glycidyl group} = (A-B)/A \times 100 \text{ (mol \%)}$$

Wherein, A represents a mole number of glycidyl-group-containing monomers used in a synthesizing process, of said copolymer and B represents a number of epoxy rings in a synthesized copolymer.

A glycidyl acrylate copolymer or a glycidyl methacrylate copolymer relating to the invention may be synthesized in the well-known emulsification polymerization processes. For example, the preparation thereof may be made by emulsion-copolymerizing a monomer which is to be copolymerized in the presence of water, an emulsifier, a polymerization initiator, a polymerization regulator (i.e., a chain transfer agent), and the like.

As for the described emulsifiers, for example, such a synthetic surface active agent as sodium dodecyl benzene sulfonate or the like may be given.

As for the polymerization initiators, an organic or inorganic paroxide or a peroxy acid salt may be given.

As for the polymerization regulators, such a mercaptan as t-nonyl mercaptan or the like may be given.

The glycidyl acrylate copolymers or the glycidyl methacrylate copolymers relating to the invention are characterized in that the epoxy ring opening ratio of the glycidyl group thereof is from 5 to 35 mole % as described above, and as for how to make the ring opening ratio of glycidyl group be desirable, there may be given such as a method in which a kind of the polymerization initiators and the quantity thereof are suitably selected in an emulsion polymerization reaction; another method in which a polymerization temperature and a polymerization reaction time are suitably determined; and the like.

The copolymers of the invention are dispersed in the form of fine grains into an aqueous dispersion medium to prepare an aqueous composition of copolymers so that they may be used as a subbing solution.

The aqueous dispersion media mentioned herein mean the dispersion media in which water or a part of water is substituted by a water-mixable organic solvent such as methanol, acetone or the like. The copolymers of the invention prepared in the described emulsion polymerization process are obtained in the form of an aqueous dispersion solution of a finely granulated emulsion polymer, that is, the so-called latex.

Various kinds of copolymeric aqueous compositions containing the copolymers of the invention (i.e., subbing solutions) may be selectively used according to the purposes of the use and the coating methods thereof. It is however preferable to use the copolymers to be prepared as an aqueous dispersion solution, so that they may be diluted if necessary with water or a water-mixable organic solvent and the density of the solid of the copolymers may be 0.1 to 40% by weight.

Thus prepared subbing solution whose main component is a copolymeric latex, i.e., a subbing resin, of the invention contains the described copolymeric component of 0.1 to 40% by weight and if occasion demands such an additive as a surface active agent, a hydrophilic organic colloid, a matting agent, a lubricant, an antistatic agent, a coupling agent and the like may be contained therein. As for the coupling agents, they may be referred in C. E. K. Mees and T. H. James, "The Theory of the Photographic Process", pp. 54–60, 3rd Ed., 1967, Japanese Patent O.P.I. Publication No. 11118/1974, Japanese Patent Examined Publication No. 6151/1972 and the like. As for the so-called hardening agents of photographic gelatin, there may be used an aldehyde compound such as formaldehyde, glyoxal and the like; mucochloric acid, an ethyleneimine-containing compound such as mucochloric acid, tetramethylene-1,4-bis (ethylene urea), hexamethylene-1,6-bis (ethylene urea), and the like; a methane sulfonic acid ester such as trimethylene-1,3-bismethane sulfonic acid ester and the like; an active vinyl compound such as bisacryloyl urea, methaxylene vinyl sulfonic acid and the like; an active halogen-containing compound such as 2-methoxy-4,6-dichlorotriazine, 2-sodiumoxy-4,6-dichlorotriazine, and the like; an epoxy group-containing compound such as bisphenol glycidyl ether and the like; isocyanate; and the like. Inter alia, an ethylene imine-containing compound, a methane sulfonic acid ester and an active halogen-containing compound are preferable in particular.

It may be considered that there is some interaction between the terminal group produced by opening the ring of a glycidyl group and a coupling agent, and therefore a further remarkable effect may be displayed in the case that such a coupling agent is used in combination as compared with the case of no coupling agent is used.

The described subbing solution is coated on a polyester film. Polyesters mentioned herein means those comprising an aromatic dibasic acid and glycol as the principal components, and polyethylene terephthalate, polyethylene naphthalate and the like may be typically given as the examples thereof.

There is no particular limitation in the thickness of polysters, and inter alia the thickness of the order of about 12$\mu$ to 500$\mu$, and preferably, of the order of 40$\mu$ to 200$\mu$, is advantageous from the viewpoints of handling and a wide use. In particular, those of a biaxial elongation crystal type are conveniently used from the viewpoints of the stability, strength and the like.

It is preferred to make the surface of a polyester film hydrophilic by selectively applying thereto with various types of surface active treatments before the describes subbing solution is coated on the polyester film. As for the surface active treatments, there may be given as the examples, an oxidizing solution treatment as described in U.S. Pat. No. 2,943,937; an ultraviolet ray absorbing treatment as described in U.S. Pat. No. 3,475,193; a corona discharge treatment as described in U.S. Pat. No. 3,615,557; an activated gas irradiation treatment as described in British Pat. No. 1,215,134; a flame treatment as described in U.S. Pat. No. 3,590,107; and the like.

The described subbing solution is coated on a polyester film in a well-known method such as a curtain coating, a reverse-roll coating, a fountain air doctor coating, a slide hopper coating, an extrusion coating, a dip coating and the like. In these methods, the amount of such copolymers coated is preferably from 0.01 to 5 g/m$^2$, and more preferably from 0.03 to 2 g/m$^2$. The drying process after coating the subbing solution may be made in a well-known method, such as a heat-air drying, an infrared-heat drying, a heater-roll drying, a micro-wave drying and the like. In the invention, it is preferred to coat on the subbing layer with an upper layer. As for the upper layer, there may be coated a natural hydrophilic organic colloid such as well-known gelatins, casein and the like; a hydrophilic macromoecular solution such as a synthetic hydrophilic organic colloid, an antistatic agent as described in Japanese Patent Examined Publication Nos. 24159/1971 and 23828/1974 and Japanese Patent O.P.I. Publication No. 93165/1973. Such upper layer solutions are allowed to contain a matting agent, hardening agent, surface active agent and the like. For coating and drying such upper layer solution, any one of the well-known methods may be applied similar to the cases of processing a lower layer. Before coating or after drying these subbing solution and if necessary a coating solution for an upper layer, there may be applied a well-known surface treatment such as a flame fusion treatment, a prasma treatment, a corona discharge treatment, a glow discharge treatment, an ultraviolet ray irradiation treatment and the like.

Thus, the supports for photographic use relating to the invention provided on at least one of the surfaces thereof with a subbing layer, may be coated on at least one of the surfaces thereof with a photographic hydrophilic colloidal layer, in a method being usually used. To be more concrete, there can be coated on the described supports with various compositions for forming a photographic light-sensitive layer such as a silver halide photographic emulsion, a diazo light-sensitive composition, a gelatin composition containing an anithalation agent, or a gelatin-backing composition for balancing the curl of a film support; and the photographic light-sensitive materials thus manufactured are excellent in adhesion, so that the photographic light-sensitive layer thereof cannot be peeled off from the support and the photographic performance thereof cannot also be affected even if a photographic process such as a development process is applied thereto.

Next, the invention will be more concretely described in its embodied examples, and it is however to be understood that the invention shall not be limited to the specific embodiments thereof. In the description hereunder, the term, "part" or "parts" means "part by weight" or "parts by weight" respectively unless otherwise specified.

Now, the evaluation method taken in the examples will be described.

(1) Adhesion test (Dried layer adhesion test)

A sample of photographic hydrophilic colloidal layer is scratched shallowly in checkered pattern by using a razor's edge and thereon a cellophane-made adhesive tape is pressed. The tape is then instantaneously peeled off from the layer. The area of the layer remaining on the support after peeling off is expressed as a percentage to the area of the tape adhered to the layer.

(Processed layer adhesion test)

A sample of photographic hydrophilic colloidal layer is scratched in checkered pattern by a sharp point of a drill or the like and the surface of the layer thus patterned is scrubbed. The area of the layer remaining on the support is expressed as a percentage to the scrubbed area. If the percentage is not smaller than 80%, there is no problem practically.

(2) Mechanical stability test

A latex solution is agitated in a container by a spindle revolving at the high-speed of 14,000 rpm. The agitation is tried by means of a high-speed agitator mfd. by Kamishima Mfg. Works and in conformity to JIS K-6381 until a flocculate is produced. The period of time to be taken to produce such a folcculate is expressed per unit of minute. If it takes for no shorter than 30 minutes, there is no hindrance.

EXAMPLE 1

A corona discharge treatment was applied at 30 W/m$^2$min. to a polyethylene terephthalate film of 100$\mu$ in thickness after thermally setting with a biaxial stretching.

Next, a subbing solution comprising 50 parts by weight of ethyl acrylate and 50 parts by weight of glycidyl methacrylate was prepared by adding water to 3 grams of copolymer whose ring-opening ratio of the glycidyl group was 20 mole % and 200 grams of saponin, to make 100 cc. Thus prepared subbing solution was coated on the described film so that the thickness of the coated layer may be 20$\mu$, and thus coated film was then dried at 100° C. for one minute. Further, a coating solution for the upper layer comprising 1 g of gelatin, 20 mg of saponin and 100 cc of pure water was coated thereon so that the thickness of the layer may be 20$\mu$, and thus coated film was dried at 100° C. for one minute. The sublayered polyester film thus obtained in the above-mentioned processes was coated with a backing layer for graphic arts light-sensitive materials.

The other samples of the invention and the control examples were respectively prepared by applying the subbing layers and coating with the backing layers in the absolutely same manner as taken in the above-mentioned example, except that the copolymers of the subbing solutions were replaced by those indicated in Table 1 below. The results of the evaluation were shown in Table 1.

TABLE 1

| Sample | Composition of copolymer | Ring-opening ratio | Mechanical stability | Adhesion after development | Adhesion after drying |
|---|---|---|---|---|---|
| 1. | 50 parts by wt. of glycidyl methacrylate<br>50 parts by wt. of Ethyl acrylate | 20 mole % | Not shorter than 30 min. | 95 | 90 |
| 2. | 20 parts by wt. of glycidyl methacrylate<br>50 parts by wt. of butyl acrylate<br>40 parts by wt. of styrene | 20 mole % | Not shorter than 30 min. | 95 | 90 |
| 3. | 2 parts by wt. of glycidyl acrylate<br>40 parts by wt. of isoprene<br>58 parts by wt. of styrene | 20 mole % | Not shorter than 30 min. | 85 | 90 |
| 4. | 2 parts by wt. of glycidyl acrylate<br>40 parts by wt. of isoprene<br>58 parts by wt. of styrene | 40 mole % | Not shorter than 30 min. | 80 | 60 |

From the results shown in the table, it is understandable that, as displayed in the samples No. 1 through 3, the subbing layers each using the subbing solution containing the copolymers having the ring-opening ratio specified in the invention, are exellent particularly in the adhesion in drying or developing process as compared with the control sample No. 4.

EXAMPLE 2

A corona discharge treatment was applied at 30 W/m$^2$min. to a polyethylene terephthalate film of 100$\mu$ in thickness after thermally setting with a biaxial stretching.

Next, a subbing solution comprising 30 parts by weight of glycidyl methacrylate, 50 parts by weight of propyl acrylate and 20 parts by weight of styrene was prepared by adding water to 5 grams of copolymer whose ring-opening ratio of the glycidyl group was 5 mole % and 20 mg of saponin, to make 100 cc. Thus prepared subbing solution was coated on the described film so that the thickness of the coated layer may be 20$\mu$, and thus coated film was then dried at 100° C. for one minute. Further, a coating solution for the upper layer comprising 1 g of gelatin, 20 mg of saponin and 100 cc of pure water was coated thereon so that the thickness of the layer may be 20$\mu$, and thus coated film was dried at 100° C. for one minute. The sublayered polyster film thus obtained in the above-mentioned processes was coated with a backing layer for graphic arts light-sensitive materials. The subbing processes were applied and the backing layers were also coated to the other samples respectively in the absolutely same manner, except that the ring-opening ratio of the glycidyl group of the copolymers of the subbing solution was changed as shown in Table below. The results of the evaluation are shown in Table 2.

TABLE 2

| Sample | Ring-opening ratio | Mechanical stability | Adhesion after development | Adhesion after drying |
|---|---|---|---|---|
| 4. | 5 mole % | Not shorter than 30 min. | 90 | 90 |
| 5. | 20 mole % | Not shorter than 30 min. | 95 | 90 |
| 6. | 30 mole % | Not shorter than 30 min. | 90 | 85 |
| 7. | 2 mole % | Not shorter than 30 min. | 70 | 90 |
| 8. | 40 mole % | Not shorter than 20 min. | 70 | 70 |

From the results shown in the table, it is understandable that the subbing layers (Sample Nos. 4–6) containing the copolymers having the ring-opening ratio specified in the invention, are excellent in mechanical stability and adhesion of the layers in both developing and drying processes, as compared with the samples No. 7 to 8 which are not of the invention.

EXAMPLE 3

A corona discharge treatment was applied at 30 W/m$^2$min. to a polyethylene terephthalate film of 100$\mu$ in thickness after thermally setting with a biaxial stretching.

Next, a subbing solution comprising 40 parts by weight of glycidyl methacrylate and 40 parts by weight of butyl acrylate and 20 parts by weight of styrene was prepared by adding water to 2 grams of copolymer whose ring-opening ratio of the glycidyl group was 20 mole %, 300 mg % saponin and 30 mg of hexamethylene-1,6-bis (ethylene urea) to make 100 cc. Thus prepared subbing solution was coated on the described film so that the thickness of the coated layer may be 20$\mu$, and thus coated film was then dried at 100° C. for one minute. Further, a coating solution for the upper layer comprising 1 g of gelatin, 20 mg of saponin and 100 cc of pure water was coated thereon so that the thickness of the layer may be 20$\mu$, and thus coated film was dried at 100° C. for one minute. The sublayered polyester film thus obtained in the above-mentioned processes was coated with a backing layer for graphic arts light-sensitive materials.

The subbing processes were applied and the backing layers were also coated to the other samples respectively in the absolutely same manner, except that the ring-opening ratio of the glycidyl group of the copolymers of the subbing solution was changed as shown in Table below. The results of the evaluation are shown in Table 3.

TABLE 3

| Sample | Ring-opening ratio | Mechanical stability | Adhesion after development | Adhesion after drying |
|---|---|---|---|---|
| 9. | 5 mole % | Not shorter than 30 min. | 95 | 95 |
| 10. | 20 mole % | Not shorter than 30 min. | 100 | 95 |
| 11. | 30 mole % | Not shorter than 30 min. | 100 | 95 |
| 12. | 2 mole % | Not shorter than 30 min. | 70 | 90 |
| 13. | 40 mole % | Not shorter than 20 min. | 75 | 70 |

As is obvious from the table, it is understandable that Samples No. 9 through 11 each comprising the subbing layer containing the copolymers whose ring-opening ratio of the glycidyl group is set in accordance with the invention, are excellent in mechanical stability and in adhesion of the layers in both of developing and drying processes, as compared with the control samples No. 12 and 13.

Method of preparation (1) Preparation of Sample 1, 2, 5-13 used in Example 1, 2 and 3

200 ml of distilled water which has been deaerated and sodium dodecylbenzensulfonate as an emulsifier are placed into 500 ml four-necked flask equipped with a stirrer, a reflux condenser, a temperature control type heating apparatus, a thermometer and a dropping funnel. The contents of the flask are stirred at a rate of 250 r.p.m. while heating said flask to maintain the temperature within the flask at 60° C.

0.15 g of ammonium persulfate as a polymerization initiator and 0.15 g of sodium hydrogen sulfite as a polymerization promotor are further added to the flask. Subsequently, the flask is charged with one tenth of each of the predetermined amounts of monomers indicated in Example 1–3 and allowed to stand for 10 minutes beginning with the initiation of polymerization. Then, the flask is charged dropwise with the remaining portions of the monomers at predetermined time intervals covering a period of 50 minutes.

Since heat is given off during addition of the monomers due to heat of polymerization, the flask is cooled so that the temperature within said flask is constantly maintained at 60° C. After adding all of the monomers, the polymerization is almost complete when the reaction is continued for an additional period of 4 hours. Each of the copolymers thus prepared is in the form of an aqueous dispersion of a particulate emulsion-polymerizate. Epoxy-ring-opening ratio of glycidyl group of the copolymer in this dispersion was 2% (Sample 7, 12). Additionally the sample 1, 2, 5, 6, 8, 9, 10, 11 in which epoxy-ring-opening ratio of glycidyl group is shown in tables were obtained by treating said dispersion thermally as follows:

| Ring opening ratio | heat treatment | |
|---|---|---|
| | temperature | time |
| 5 mole % (Sample 4, 9) | 80° C. | 1 hour |
| 20 mole % (Sample 1, 2, 5, 10) | 90° C. | 2 hours |
| 30 mole % (Sample 6, 11) | 90° C. | 3 hours |
| 40 mole % (Sample 8, 13) | 95° C. | 3 hours |

(2) Preparation of Sample 3 and 4 used in Example 1

The starting material (shown below) is placed into a 100 ml pressure amplue for polymerization. The ampule is then completely sealed. The ampule is placed in a shaking type thermostat wherein the temperature therein is constantly maintained at 60° C., and the ampule is vibrated at 100 times per minute.

| | |
|---|---|
| Deaerated distilled water | 50 ml |
| Sodium dodecylbenzensulfonate | 0.25 g |
| Ammonium persulfate | 0.200 g |
| Isprene | 10.4 g |
| Styrene | 15.08 g |
| Glycidyl acrylate | 0.52 g |

The polymerization reaction is continued for 5 hours in the above manner to obtain a copolymer (an aqueous dispersion). Epoxy-ring-opening ratio of glycidyl group of the copolymer was 20% (Sample 3). Sample 4 which has epoxy-ring-opening ratio of 40% was obtained by treating said copolymer thermally at 80° C. for one hour.

What is claimed is:

1. A support for photographic use comprising a polyester film with at least one surface having a layer provided by coating with an aqueous coating composition, said coating composition comprising about 0.1% to about 40% by weight of a copolymer containing (a) 0.01% to 70% by weight glycidyl acrylate or glycidyl methacrylate with an epoxy-ring-opening ratio of the glycidyl group to the whole amount of epoxy rings of from 5 to 35 mole %; and (b) a monomer polymerizable with said glycidyl group selected from the group consisting of alkylacrylic acid ester, an alkylmethacrylic acid ester, an acrylamide, an N-alkylacrylamide, vinyl chloride, vinylidene chloride, styrene, a styrene derivative, a vinyl ether, a vinyl ester, a diolefin or a combination thereof.

2. The support according to claim 1, wherein the monomer polymerizable with the component of said copolymer is alkyl acrylate.

3. The support according to claim 1, wherein said monomer is a combination of alkyl acrylate and styrene.

4. The support according to claim 1, wherein said monomer is a combination of a diolefin and styrene.

5. The support according to claim 1, wherein the epoxy-ring-opening ratio of said glycidyl group is from 10 to 25 mol % to the whole amount of epoxy rings.

6. The support according to claim 1, wherein said aqueous coating composition contains a compound having an ethyleneimine group and a compound having a methane sulfonate or an active halogen.

7. The support according to claim 1, wherein said polyester film further comprises an upper layer thereon.

8. The support according to claim 7, wherein said layer is a hydrophilic colloidal layer.

* * * * *